United States Patent [19]

Reneau et al.

[11] 4,408,759

[45] Oct. 11, 1983

[54] TOTAL RESISTANCE GYM

[75] Inventors: J. R. Reneau; Richard D. Relyea, both of Austin, Tex.

[73] Assignee: Bullseye Gun Centers, Inc., Austin, Tex.

[21] Appl. No.: 125,202

[22] Filed: Feb. 27, 1980

[51] Int. Cl.[3] ..... A63B 21/00

[52] U.S. Cl. ..... 272/131; 272/132; 272/134

[58] Field of Search ..... 272/132, 131, 143, 144, 272/DIG. 3, 72

[56] References Cited

U.S. PATENT DOCUMENTS

| | | | |
|---|---|---|---|
| 3,904,196 | 9/1975 | Berlin | 272/132 X |
| 3,953,025 | 4/1976 | Mazman | 272/132 |

FOREIGN PATENT DOCUMENTS

| | | | |
|---|---|---|---|
| 966523 | 4/1975 | Canada | 272/131 |
| 2152399 | 4/1973 | Fed. Rep. of Germany | 272/131 |
| 1253188 | 12/1960 | France | 272/131 |

*Primary Examiner*—Richard C. Pinkham
*Assistant Examiner*—William R. Browne
*Attorney, Agent, or Firm*—Gunn, Lee & Jackson

[57] ABSTRACT

In the preferred and illustrated embodiment of an exercise device, a free standing frame with adjustable resistance assemblies mounted to the frame is disclosed. Resistance in all directions is provided by a linear drag brake and a rotary drag brake. The linear drag brake comprises a slide bar reciprocably movable between two friction pads. The rotary drag brake comprises an arm member pivotally mounted between two friction pads. The exercise device provides active resistance through a full range of motion both in flexion and extension.

4 Claims, 10 Drawing Figures

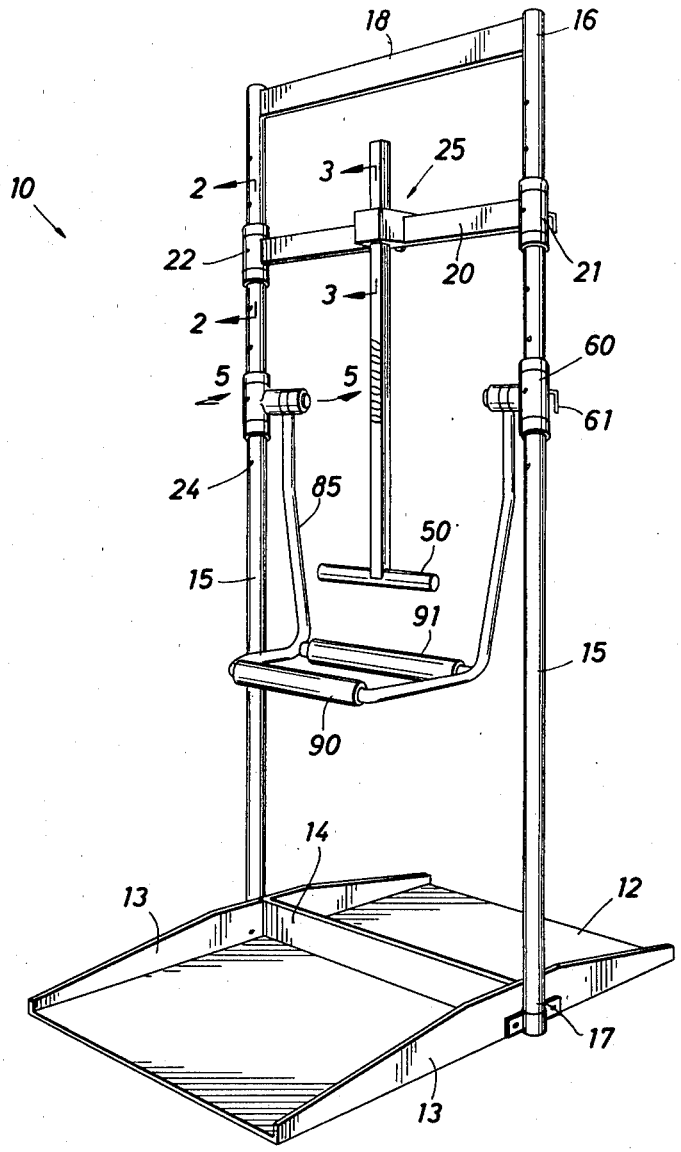
FIG. 1
FIG. 10
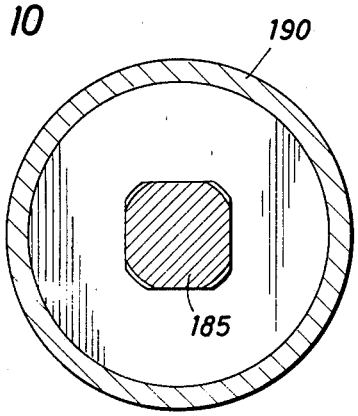
FIG. 2
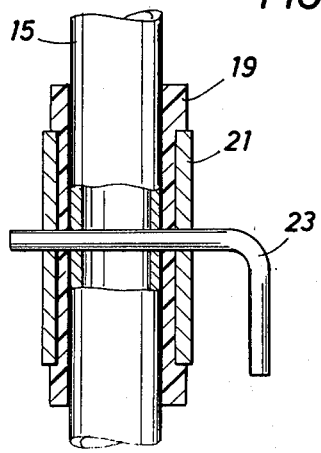

FIG. 5
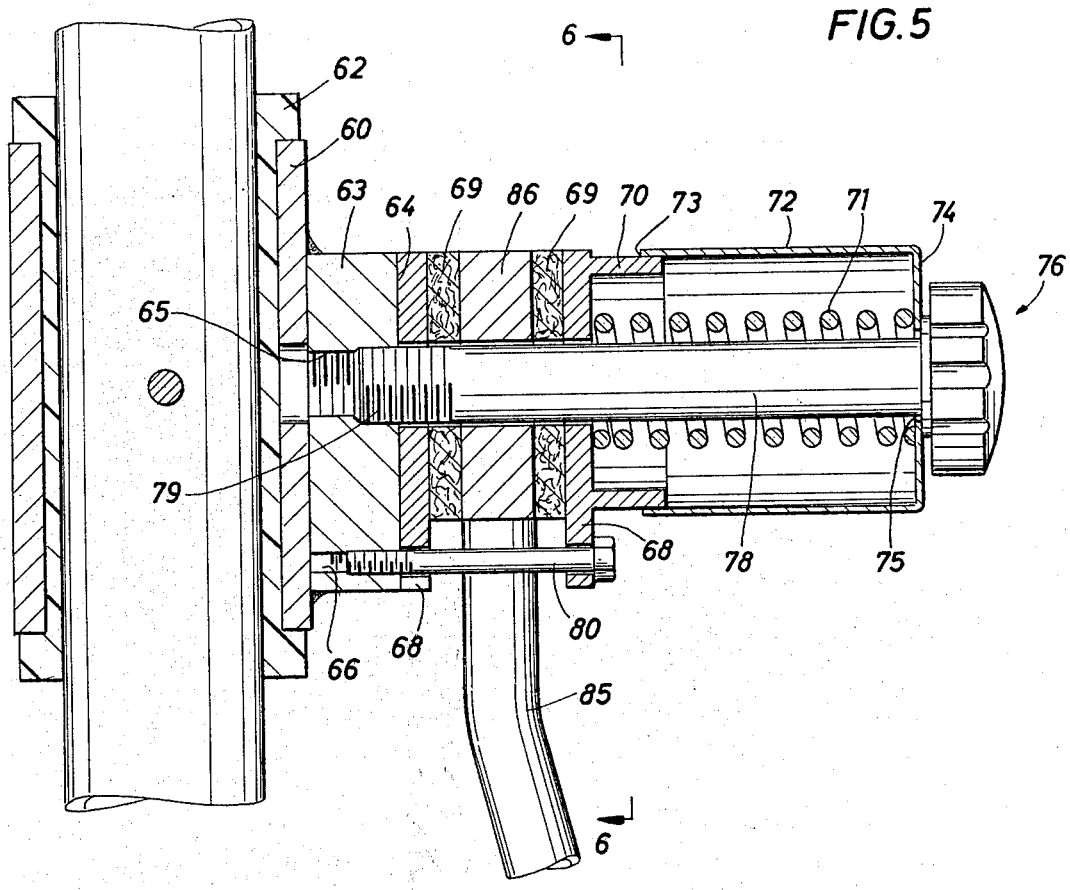
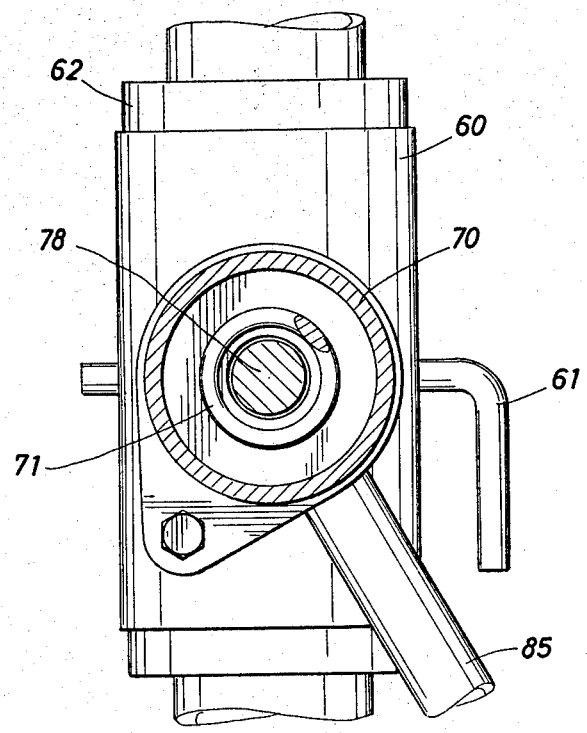
FIG. 6

TOTAL RESISTANCE GYM

BACKGROUND OF THE INVENTION

This invention relates generally to exercise devices and more particularly to devices which provide active resistance through a full range of motion.

Most currently available exercise devices are not capable of providing two-way resistance through a full range of motion. They generally employ weights, pulleys, ropes or multiple machines to provide resistance to a particular motion. For example, exercise devices which work on a weight or spring basis resist the exerciser in one direction, but do not resist in the other direction. Thus, these devices exercise the middle part of the muscle, resulting in a short, fatter muscle.

There is a desire among exercisers for muscle strength without bulk, as not all exercisers are interested in building bulging muscles. Building a strong, supple muscle requires two-way resistance. Presently available exercise devices do not satisfy this desire as most are not equipped to supply two-way resistance throughout a full range of motion.

BRIEF SUMMARY OF THE INVENTION

The exercise device of this disclosure provides two-way resistance, resisting the exerciser in both the flexion and extension of the muscle. The exercise device comprises a lightweight portable frame secured to a base member. Mounted on the frame are two adjustable resistance assemblies. The resistant force for one resistance assembly is supplied by a linear drag brake. The second resistance assembly mounted on the frame is a rotary drag brake. Both brakes are of simple design with a minimum of moving parts. The brakes are a pair of friction pads engageable with a slide surface. An adjustable spring acts on the friction pads to maintain a desired resistance force which is equal in all directions of movement. The resistance assemblies are also vertically adjustable on the frame to accommodate the different heights of exercisers.

A major object of the invention is, therefore, to provide a device in which the resistance force is a full range, two-way resistance. This is accomplished in conjunction with another feature of the invention providing an exercise device in which the resistance force is adjustable between limits.

The equipment is useful at home, particularly being movable to a convenient area for use. This advantage flows from the lightweight construction which enhances the portable nature of the device. Home use for a family is easily obtained utilizing one feature of the exercise device which is adjustability to the height of the exerciser.

The disclosure, in summary form, describes a portable frame over a base typically rested on the floor. In conjunction with a bench over the base, the user moves through linear or rotational exercises by grasping and forcing handles to move against linear and rotational brakes. Adjustments to accommodate size and strength are accomplished at setup.

BRIEF DESCRIPTION OF THE DRAWINGS

So that the manner in which the above recited features, advantages and objects of the invention, as well as others which will become apparent, are attained and can be understood in detail, a more particular description of the invention briefly summarized above may be had by reference to the embodiments thereof illustrated in the appended drawings, which drawings form a part of this specification. It is to be noted, however, that the appended drawings illustrate only typical embodiments of the invention and are not to be considered limiting of its scope, for the invention may admit to other equally effective embodiments.

FIG. 1 is a perspective view of a preferred embodiment of the invention;

FIG. 2 is a cross-sectional, broken away view taken along the line 2—2 of FIG. 1 showing the slide sleeve of the present invention;

FIG. 5 is a cross-sectional view of the rotary drag brake of the present invention;

FIG. 6 is a cross-sectional view of the rotary drag brake taken along the line 6—6 of FIG. 5;

FIG. 10 is a cross-sectional view along the line 10—10 of FIG. 9 showing the milled support rod of the rotary drag brake of the alternate embodiment.

DETAILED DESCRIPTION OF THE PREFERRED EMBODIMENT

Figure 3:
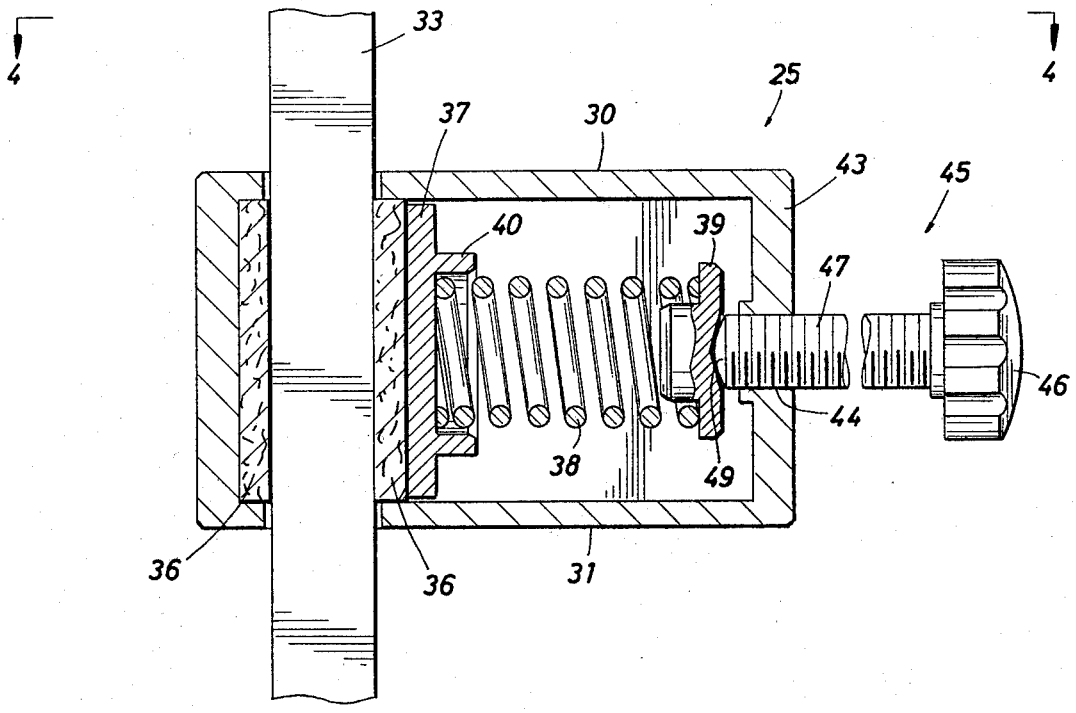
FIG. 3 is a cross-sectional view of the linear drag brake of the present invention.
Figure 4:
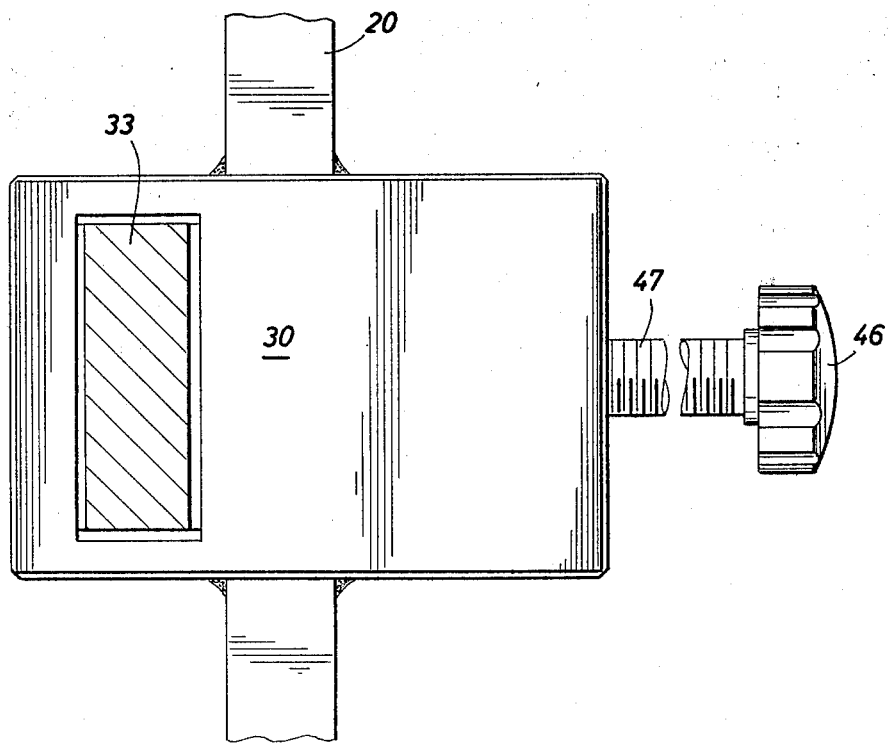
FIG. 4 is a top view of the linear drag brake taken along the line 4—4 of FIG. 3.

Referring first to FIGS. 1–4 of the drawings, the exercise device 10 has a free standing frame mounted on a base. The base comprises a flat bottom portion 12 and two spaced and parallel sidewalls 13. To add rigidity to the base, a horizontal connecting member 14 is secured to the interior of sidewalls 13 at approximately the midpoint thereof. The base is formed of sheet stock material of suitable strength. A bench can be rested on the base (not shown for sake of clarity) on which the user can sit or recline to vary the exercises.

The frame of the exercise device 10 is defined by two leg members 15 having an upper end 16 and a lower end 17. A transverse connecting rod 18, equal in length to the width of the base, if fixed to the upper ends 16 of the leg members 15. The connecting rod 18 adds rigidity to the frame and maintains the spacing between the leg members 15 so that the leg members 15 are parallel. The lower ends 17 of the leg members 15 are bolted to the base. Thus, the exercise device 10, when assembled, is free standing and portable. The frame is symmetrical along a vertical dividing line.

The linear resistance assembly comprises a support bar 20 with sleeve guides 21 attached to each end thereof and a brake housing 25 affixed at approximately the midpoint of the support bar 20. The sleeve guides 21 have an open cylindrical shape so that the leg members 15 may slide therethrough with a minimum of wobble. Additionally, as best shown in FIG. 2, the sleeve guides 21 have a pair of aligned holes 22 for receiving a retaining pin 23. The leg members 15 have a plurality of pairs of aligned holes 24. The holes 22 are aligned with the holes 24 at a desired level, and the pin 23 is inserted so as to extend through the leg members 15 and the sleeve guides 21 as shown in FIG. 2. Thus, the resistance assembly may be moved up and down the leg members 15 to any desired elevation. Tubular packing material 19 is disposed between the sleeve guides 21 and the leg members 15 to establish a tighter connection between the parts and to reduce or eliminate noise which may be generated at the connection.

Figure 7:
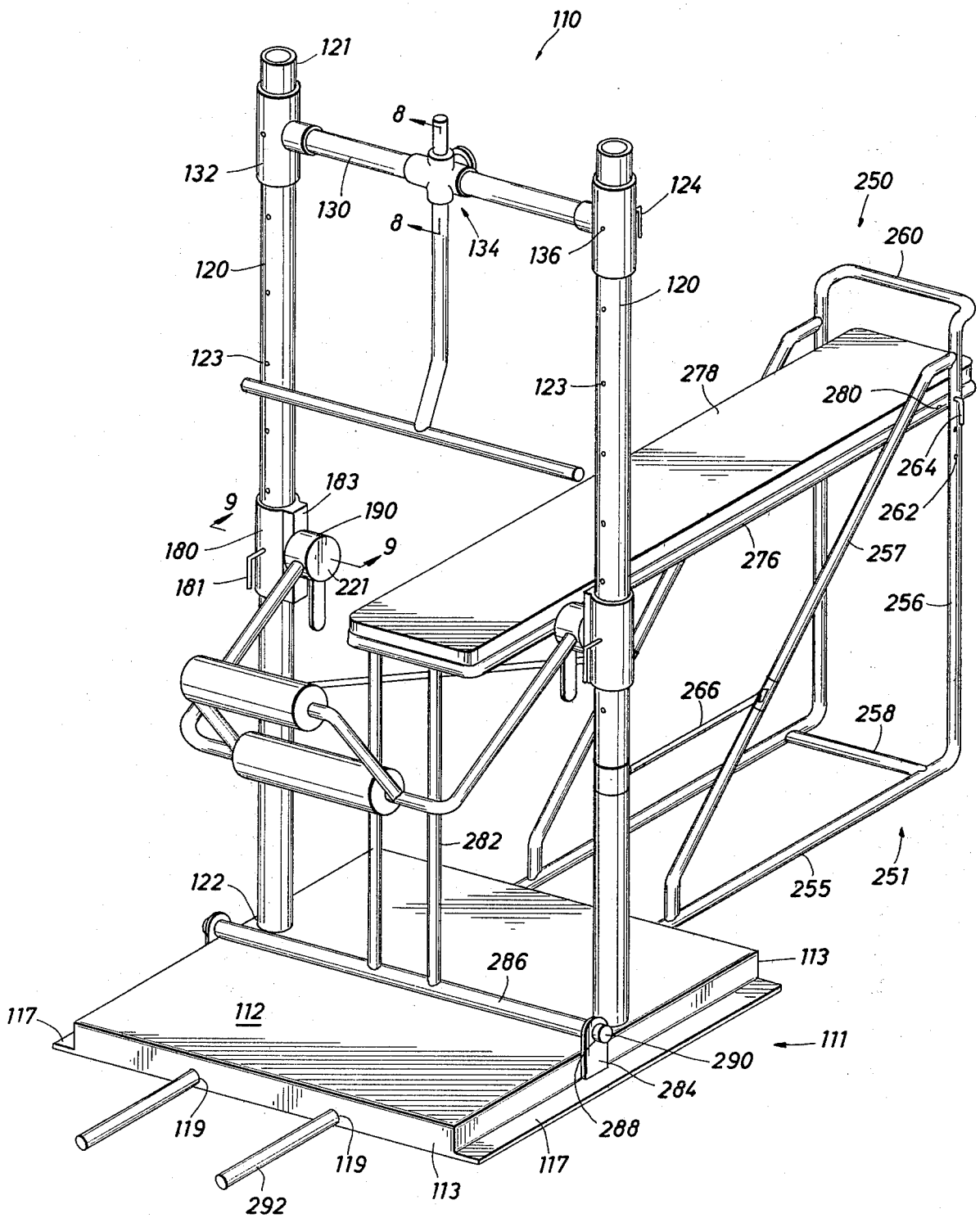
FIG. 7 is a perspective view of an alternate embodiment of the invention.

The linear brake housing 25 is located at about the midpoint of the support bar 20. It may be secured to the support bar 20 by welding, brazing or the like. The housing 25, as best shown in FIG. 3, has a box-like, rectangular shape. A rectangular hole extends through a top wall 30 and is aligned with an identical rectangular hole extending through the bottom wall 31 for receiving an elongate, rectangular-shaped slide bar 33 therethrough. The slide bar 33 is slightly smaller in cross section than the rectangular holes in the housing 25 so that the sides of the slide bar 33 do not contact the housing 25. The housing 25 also has a notch corresponding to the width of the support bar 20 cut out of its sidewalls so that the housing 25 may be slipped onto the support bar 20 and welded thereon as shown in FIG. 7.

Arranged within the housing 25 are two friction pads 36, a backing plate 37, a spring 38 and a compression plate 39. The opposing friction pads 36 are rectangular in shape, having a longitudinal dimension equal to the interior height of the housing 25 and a width or horizontal dimension equal to the width of the slide bar 33. The friction pads 36 are spaced apart to enable the slide bar 33 to be sandwiched between them. The backing plate 37 has a shape approximating that of the friction pads 36. The backing plate 37 is on the spring side of the friction pads 36 and includes an open end, cylindrical protrusion 40 extending from the back surface thereof. One end of the coil spring 38 is received by the protrusion 40. The other end of the spring 38 is capped by the circular compression plate 39. The spring 38 is aligned and secured within the housing 25 perpendicular to the slide bar 33 so that the force exerted by the spring 38 on the friction pads 36 is normal to the surface of the slide bar 33. The pads are matted fiber brake material typified by asbestos, fiberglass or the like. They retard movement of the bar 33.

The housing 25 includes a back wall 43 having a threaded hole 44 extending therethrough. The hole 44 aligns with the spring 38 and the protrusion 40. An adjustment bolt 45, comprised of a head 46, a threaded shaft 47 and an end 49, is threaded through the hole 44. The end 49 of the adjustment bolt 45 engages the back surface of the compression plate 39 so that a compressive force is applied to the spring 38 by tightening the adjustment bolt 45. The friction force acting against the slide bar 33 may thus be set to a desired value by turning the adjustment bolt 45.

The slide bar 33, the actuating member in the linear drag brake assembly, is an elongated, rectangular-shaped shaft preferably about 3.0 feet in length. A handle 50 is secured to one end of the slide bar 33. The surfaces of the slide bar 33 in contact with the friction pads 36 are cross-hatched to wipe the friction pads 36 on each pass as the slide bar 33 is reciprocated by the exerciser. The handle 50 and the bar 33 are scaled to a size accommodating the user. The pads 36 frictionally clamp against the bar 33 as it moves. They frictionally drag or retard bar movement during its use, creating a drag force which is constant so long as the contacting surfaces are uniform in surface friction.

The rotary resistance assembly assists the user in his exercises in the same fashion as the linear resistance assembly, namely, providing constant frictional resistance during pivotal or rotational movement about a support shaft. Included in the rotary drag brake assembly (see FIGS. 5 and 6) are two adjustable sleeve guides 60 which are identical to the sleeve guides 21 which are held in position on the leg members 15 by the retaining pins 61. Tubular, hollow packing material 62 is disposed between the leg members 15 and the interior walls of the sleeve guides 60. Extending from and perpendicular to the sleeve guides 60 are solid cylindrical protrusions 63. The end surface 64 of the protrusions 63 contains two drilled, threaded holes 65 and 66. The hole 65 is centrally located on the surface 64, and the hole 66 is circumferentially located on the surface 64 and offset from the hole 65. The hole 65 is adapted to receive the threaded end 79 of the pivot bolt 76, and the hole 66 is adapted to receive the threaded end of the retainer bolt 80.

The arrangement of frictional parts of the rotary drag brake assembly is similar to the linear drag brake assembly. While only one rotary drag brake assembly will be described, it is understood that two identical assemblies are mounted on the exercise frame. The pivot end 86 of the actuating arm 85 is a flat, circular appendage sandwiched between a pair of friction pads 69. Two similar backing plates 68 are deployed, one bonded to each of the friction pads 69. A cylindrical, open end protrusion 70 extends from the spring side of the backing plate 68 and is adapted to receive one end of a coil spring 71. A hollow, cylindrical housing 72 encloses the coil spring 71. The open end 73 of the housing 72 surrounds and telescopes over the backing plate protrusion 70. A terminal end 74 of the housing 72 has a hole 75 for receiving the bolt shaft 78. The two backing plates 68, the contacting friction pads 69 and the arm pivot end 86 also have holes extending therethrough for receiving the bolt shaft 78. The spring 71 is slipped on the bolt shaft 78 between the backing plate 68 and the terminal end 74 of the sleeve housing 72. The holes in the backing plates 68, the friction pads 69 and the arm pivot end 86 are aligned, and the bolt shaft 78 is passed therethrough and threaded into the hole 65 of the cylindrical protrusion 63. The retainer bolt 80 is threaded into the offset hole 66 after passing through an ear (see FIG. 6) to fasten the backing plates. As with the linear drag brake, the frictional force acting against the actuating arm 85 may be varied by turning the pivot bolt 76 to compress the spring 71. When the spring is tightened, frictional drag increases. The two pads 69 are fixed, while the metal flat faces of the pivot end 86 drag against the frictiion faces of the pads 69. The two metal faces on the pivot end 86 are preferably finished to equal surface roughness to prevent erratic friction on rotation. These surfaces are ideally planar and parallel to enable the device to function free of trouble. Moreover, the pads are sacrificial for ultimate replacement after significant wear has accumulated. Asbestos is an acceptable material; however, fiberglass or other similar material may also be used.

The actuating mechanisms for the rotary drag brakes are two L-shaped arms 85 interconnected by handle bars 90 and 91. The ends of the arms 85 are pivotally mounted about the bolt shaft 78 as previously described. The retainer bolt 80 extends across the swing path of the arms 85, limiting their pivot angle to a maximum of about 300.0 degrees.

An exerciser may exercise with the exercise device of the present invention from a standing, sitting or lying position. A bench may be necessary to perform various exercises from a lying or sitting position.

DETAILED DESCRIPTION OF AN ALTERNATE EMBODIMENT

Referring now to FIGS. 7 through 10, an alternate embodiment of the exercise device designated by the reference numeral 110 is disclosed. The exercise device 110 shown in FIG. 7 has a free standing frame mounted on a base 111. The base 111 has a flat top portion 112 welded on several sides 113. Two of the sides 113 form the perpendicular illustrated sides of the base 111. The other of the sides 113 (not shown) provides support around the periphery of the base 111. The corners of the base 111 are enclosed by the sides and abut spot welded, corner located, vertical posts. Additional stability of the device 110 is provided by the flaps 117 which extend outwardly from the sides a short distance, preferably about 2.0 inches, to aid in preventing tip-over of the exercise device 110. Two of the sides 113 include two holes 119 which are sized and aligned to receive a bench frame member therethrough. The top portion 112, the sides 113 and the flaps 117 may be separate parts welded together or may be an integral member shaped as shown in FIG. 7 and with corner located posts. The base 111 is formed of sheet stock material of suitable strength.

The frame of the exercise device 110 further includes two large posts 120 each having an upper end 121 and a lower end 122. The posts 120 are hollow tubular members having suitable strength for the load placed on them. The lower ends 122 of the posts 120 are secured to the base 111. The posts 120 further include vertically spaced, aligned holes 123 for receiving the retaining pins 124. The exercise device 110 is symmetrical along a vertical dividing line, free standing and portable.

The linear resistance assembly of the exercise device 110 comprises a support bar 130 with the sleeve guides 132 attached to each end thereof. A brake housing 134 is affixed at approximately the mid point of the support bar 130. The sleeve guides 132 have an open, cylindrical shape so that the posts 120 may slide therethrough with a minimum of wobble. Additionally, the sleeve guides 132 have a pair of aligned holes 136 for receiving the retaining pin 124 to mount the linear resistance assembly to the posts 120.

Figure 8:
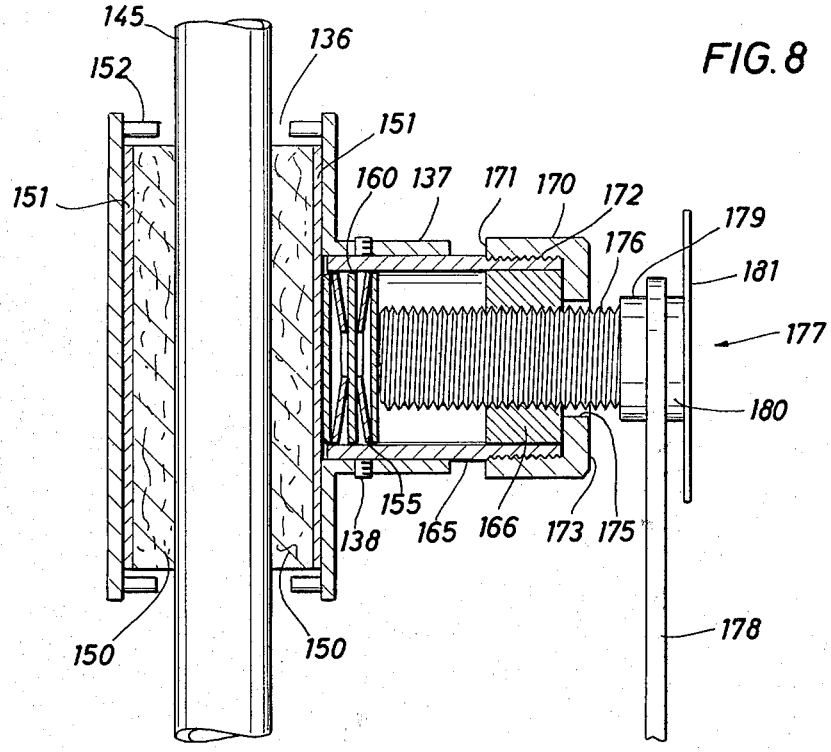
FIG. 8 is a cross-sectional view of the linear drag brake of the alternate embodiment taken along the line 8—8 of FIG. 7.
Figure 9:
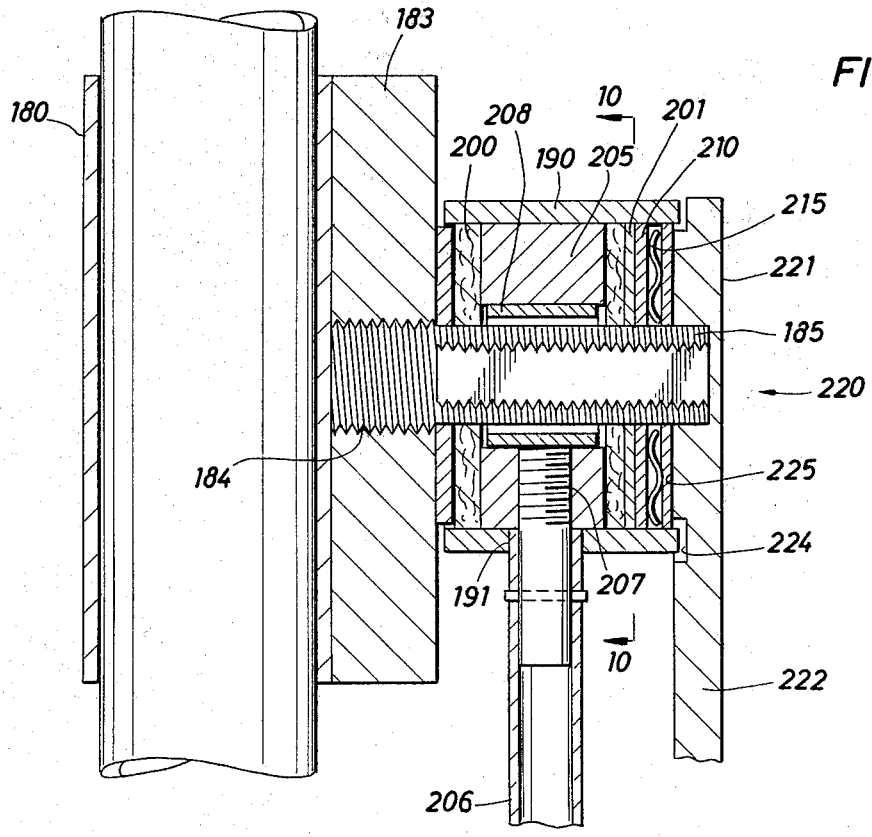
FIG. 9 is a cross-sectional view of the rotary drag brake of the alternate embodiment taken along the line 9—9 of FIG. 7.

The linear brake housing 134 is located at about the mid point of the support bar 130. It may be secured to the support bar 130 by welding, brazing or the like. The housing 134, as best shown in FIG. 7, has a cross-like shape and may be a cross speedrail cleanup or similar structure. Referring to FIG. 8, a vertical cylindrical opening 136 extends through the housing 134 for receiving an elongate, cylindrical slide bar 145 therethrough. The slide bar 145 is slightly smaller in cross section than the cylindrical opening 136 so that the slide bar 145 does not contact the housing 134 as it passes therethrough. The housing 134 also includes a hollow cylindrical extension 137 extending therefrom perpendicular to the cylindrical opening 136.

Arranged within the housing 134 are two facing friction pads 150, Belleville spring washers 155, flat steel spacers 160 and a pipe nipple 165. The friction pads 150 are semicircular to mate with the curved surface of the cylindrical slide bar 145 and are spaced apart to enable the slide bar 145 to be reciprocated between them. The friction pads 150 are matted fiber brake material typified by asbestos, fiberglass or the like bonded to semicircular backing plates 151. The friction pads 150 are retained within the cylindrical opening 136 by pins 152 which extend through holes in the housing 134. The pins 152 are disposed above and below the friction pads 150 and press fit through the holes in the housing 174. The pins 152 extend into the cylindrical opening 136 a sufficient distance to contain the friction pads 150 within the housing 134.

The pipe nipple 165 is an open end, hollow, cylindrical member which fits within the cylindrical extensions 137 of the housing 134. The pipe nipple 165 is retained in the extension 137 by a plurality of set screws 138. One end of the pipe nipple 165 is threaded on the exterior surface thereof and protrudes outwardly from the extension 137. The steel spacers 160 and the Belleville spring washers 155 are alternately arranged within the pipe nipple 165. Two spring washers 155 and three steel spacers are shown in FIG. 8; however, the number of washers and spacers may vary as required to exert a desired spring force. The spring washers 155 are sandwiched between the steel spacers 160 which have smooth, planar surfaces so that the spring washers 155 may be equally compressed over the total surface contact area between the washers and the spacers. An interiorally threaded nut 166 is press fit into the threaded end of the pipe nipple 165 for receiving the threaded shaft 176 of the adjustment bolt 177.

A pipe cap 170 having an open end 171 and interior threads 172 is threadably secured to the threaded end of the pipe nipple 165. The pipe cap 170 further includes an apertured end 173 having a hole 175 therethrough. The shaft 176 of the adjustment bolt 177 is passed through the hole 175 and threaded through the nut 166 until the end of the shaft 176 presses against one of the steel spacers 160. A compressive force is controllably applied to the spring washers 155 by tightening the adjustment bolt 177. This is accomplished by adjusting a lever 178 extending from the head 179 of the adjustment bolt 177. A vinyl spacer 180 is mounted around the bolt head 179 to carry a nameplate 181. The nameplate 181 includes calibrations on its face indicating the frictional drag resistance for each setting of the lever 178. The frictional drag resistance may thus be set to a desired value by turning the lever 178 to a particular setting to display a calibration as, for instance, an arbitrary reference.

The slide bar 145 of this embodiment is preferably of cylindrical shape and about 3.0 feet in length. A handle is secured to one end thereof so that an exerciser may reciprocate the slide bar 145. The operation of the linear drag brake assembly of this embodiment is identical to the operation of the linear drag brake assembly of the previously described embodiment.

The rotary resistance assembly of the alternate embodiment is similar to the rotary resistance assembly shown in FIG. 5 of the previous embodiment. Going now to FIG. 7, the rotary resistance assembly of the exercise device 110 has two adjustable sleeve guides 180 which are held in position on the posts 120 by the retaining pins 181. Extending from and perpendicular to the sleeve guides 180 are solid, rectangular-shaped protrusions 183 which may be welded on the sleeve guides 180 or which may be an integral part thereof. Centrally located on the face of the protrusions 183 is a threaded, blind hole 184 adapted to receive the threaded end of an all-thread support rod 185.

While only one rotary drag brake assembly will be described, it is understood that two identical assemblies are mounted on the frame of the exercise device 110. Description is enhanced by referring to FIG. 9. A cylindrical housing 190 encloses the elements of the rotary drag brake assembly. The cylindrical housing 190 is open at both ends and includes a hole 191 extending through a surface thereof. Housed within the cylindrical housing 190 are the friction pads 200, the wafer 205 of the actuating arm 206, steel washers 210 and a Belleville spring washer 215.

The wafer 205 is a cylindrical appendage of the actuating arm 206 sandwiched between a pair of friction pads 200. The wafer 205 has a threaded blind hole 207 for receiving the threaded end of the actuating arm 206. The flat planar faces of each end of the wafer 205 frictionally engage the flat planar surfaces of the friction pads 200. The friction pads 200 typically comprise asbestos or fiberglass pads bonded to metal backing plates 201. A centrally located square hole extends through the friction pads 200 and the backing plates 201 so that they may be mounted on the support rod 185 which is milled on four sides (see FIG. 10) to lock the friction pads 200 and the backing plates 201 against rotation as in a key. The wafer 205 includes a longitudinal hole extending through the center thereof sized to accommodate a hollow, cylindrical bearing 208. The bearing 208 provides a smooth, cylindrical surface enabling the wafer 205 to pivot about the support rod 185.

The rotary drag brake is assembled in the following manner. The wafer 205 is placed inside the housing 190, and the hole 207 of the wafer 205 is aligned with the hole 191 extending through the housing 190. The threaded end of the actuating arm 206 is passed through the hole 191 and threaded into the hole 207. The bearing 208 is placed in the longitudinal hole extending through the wafer 205, and the friction pads 200 are placed in the housing 190, one on each side of the wafer 205. The steel washers 210, with the Belleville spring washer 215 sandwiched therebetween, are placed in the housing 190 at the distal end thereof. The steel washers 210 and the spring washer 215 also include a square-shaped hole so that they may be mounted on the support rod 185 in the same manner as the friction pads 200. Thus assembled, the rotary drag brake assembly is journaled on the support rod 185. A cap 220 having a threaded blind hole is threaded onto the exposed end of the support rod 185 to complete the assembly of the rotary drag brake. While the support rod 185 is milled to include four flat surfaces as shown in FIG. 10, sufficient threads remain providing at least seventy-five percent (75%) thread engagement between the cap 220 and the support rod 185. Thread engagement is critical in that it must be sufficient to enable the cap 220 to securely thread onto the support rod 185.

The cap 220 includes a cylindrical head 221 and a lever 222 extending therefrom. A nameplate is mounted on the exposed side of the cylindrical head 221. The nameplate includes calibrations to indicate the frictional drag force at any particular setting of the lever 222. The interior side of the head 221 includes a circular slot 224 sized to receive the distal end of the housing 190. The head 221 further includes a surface 225 which extends inside the housing 190. The surface 225 engages one of the steel washers 210 when the cap 220 is threaded on the support rod 185. In this initial position, little or no resistance is provided by the friction pads 200. Turning the lever 222 in a clockwise direction advances the surface 225 inwardly into the housing 190. As the surface 225 advances inwardly, it compresses the spring washer 215 via one of the steel washers 210. The compressive force of the spring washer 215 is transmitted to the friction pads 200 via the other of the steel washers 210. Thus, since the wafer 205 is sandwiched between the friction pads 200, the compressive force provided by the spring washer 215 acts against the flat planar surfaces thereof as if the wafer 205 was in a vice. Since the friction pads 200 are locked on the support rod 185 and cannot rotate, a frictional drag force is encountered upon rotation of the wafer 205. This frictional drag force may be increased or decreased by adjustment of the lever 222.

One may exercise with the exercise device of the present invention from a standing or lying position. A bench designated by the reference numeral 250 specifically designed for use with the present invention is shown in FIG. 7. The bench 250 comprises a tubular frame and a detachable, padded platform. The frame includes two identical, generally triangular-shaped frame members 251. The triangular frame members 251 include three sides. A first leg 255 extends from the base 111, a second leg 256 connects to and extends vertically perpendicular to the first leg 255, and a third leg 257 connects the first leg 255 and the second leg 256. The frame members 251 are connected by a rod 258 bolted to the first leg 255 of each frame member 251. A U-shaped rod 260 connects the upper ends of the second leg 256 of each frame member 251. The rod 260 may also be used as a foot brace by the exerciser while doing situps. The third leg 257 of the frame members 251 includes a number of spaced holes 262 for receiving a pin 264 therethrough. Anchoring braces 266 are provided to anchor the bench 250 to the exercise device. The braces 266 connect the third leg 257 of the triangular frames 251 to the posts 120.

The seat of the bench 250 comprises a rectangular, tubular frame 276 and a padded platform 278 mounted thereon. The frame 276 includes several spaced holes 280 along a longitudinal side thereof which may be aligned with the holes 262 in the leg 256 for receiving the pin 264 therethrough. In this manner, the bench 250 may be inclined to various positions for different types of exercises. Extending from the end of the frame 276 opposite the holes 262 is a T-shaped leg 282 which is hinged to the frame 276. Ears 284 are secured to the sides 115 of the base 111 for anchoring the leg 282. The ears 284 extend above the top portion 112 of the base 111 to receive the T-bar 286 of the leg 282 through the aligned holes 288. The ends of the T-bar 286 which extend through the holes 288 are capped by the plastic caps 290 for cosmetic purposes. For additional stability, a pair of elongate tubular extensions 292 aligned with the ends of the legs 255 pass through the aligned holes 119 of the sides 113. The extensions 292 frictionally engage the legs 255 by telescoping over the ends thereof. The extensions 292 prevent sideway movement of the bench frame relative to the base 111.

When an exerciser has completed exercising, the exercise device of the invention may be stored in a corner of a room, closet or other suitable place. The bench is easily detached from the exercise frame by removing the pins 264 and sliding the T-bar 286 out of the anchoring ears 284 after removing the plastic caps 290. The extensions 292 are detached from the legs 255, and the anchoring braces 266 are detached from the legs 257. The platform 278 and the leg 282 are folded together for storage with the triangular frames 251 on the base 111. The total weight of the exercise device is about 50.0 pounds; thus, an individual may easily move the exercise device from one place to another.

While the foregoing is directed to the preferred and alternate embodiment of the present invention, other and further embodiments of the invention may be devised without departing from the basic concept thereof, and the scope thereof is determined by the claims which follow.

We claim:

1. An exercise device comprising:

(a) a frame extending above an open area;

(b) an adjustable resistance means mounted on said frame providing constant two-way resistance to in line reciprocating forces exerted by a user, said resistance means including spring biased friction drag means for resisting the forces exerted by a user;

(c) handle means operatively associated with said resistance means and movable with respect thereto so as to transfer energy exerted by a user during an exercise program, said handle means including an elongated arm which is in sliding contact with said friction drag means;

(d) said resistance means further including rotary drag brake means for resisting the forces exerted by a user, said rotary drag brake means comprising a sleeve guide having a protrusion extending therefrom, said protrusion including threaded hole means, a support shaft threadably secured to said protrusion, a pair of spaced and opposite friction pads simultaneously engageable about said handle means, said friction pads affixed to metal backing plates mounted on said support shaft, cylindrical housing means enclosing said rotary drag brake means, spring means mounted on said support shaft providing a compressive force acting against said friction pads, and locking means for preventing rotational movement of said friction pads and said backing plates; and (e) a bench positioned at the open area beneath said frame permitting a user to perform various exercises on manipulating said handle means, which exercises are resisted by said resistance assembly and are performed from a lying or sitting position.

2. The exercise device of claim 1 wherein said handle means includes a pair of spaced, parallel arms pivotally connected to said adjustable resistance assembly.

3. An exercise device comprising:

(a) a frame extending above an open area;

(b) rotary drag brake means mounted on said frame providing constant two-way resistance to force exerted by a user, said rotary drag brake means including spring biased friction drag means for resisting the force exerted by a user;

(c) handle means operatively associated with said rotary drag brake means and movable with respect thereto so as to transfer energy exerted by a user during an exercise program, said handle means including an arm with a distal end in sliding contact with said friction drag means;

(d) said rotary drag brake means comprising:

(1) a sleeve guide having a protrusion extending therefrom, said protrusion including threaded hole means;

(2) a support shaft threadably secured to said protrusion;

(3) a pair of spaced and opposed friction pads affixed to metal backing plates simultaneously engageable about the distal end of said arm and mounted on said support shaft;

(4) cylindrical housing means enclosing said rotary drag brake means;

(5) spring means mounted on said support shaft providing a compressive force acting against said friction pads; and (6) locking means for preventing rotational movement of said friction pads and said backing plates; and (e) a bench positioned at the open area beneath said frame permitting a user to perform various exercises on manipulating said handle means, which exercises are resisted by said rotary drag brake means and are performed from a lying or sitting position.

4. The exercise device of claim 3 wherein said support shaft comprises a milled all thread support rod having four flat surfaces thereon and providing at least seventy-five (75%) percent thread engagement.

* * * * *